US005466023A

United States Patent [19]

Williamson

[11] Patent Number: 5,466,023

[45] Date of Patent: Nov. 14, 1995

[54] SECURITY DOOR BAR SYSTEM AND METHOD OF USE

[76] Inventor: Christopher H. Williamson, 9121 Stuart St., Westminster, Colo. 80030

[21] Appl. No.: 236,889

[22] Filed: May 2, 1994

[51] Int. Cl.[6] ..... E05C 19/18

[52] U.S. Cl. ..... 292/259 R; 292/289

[58] Field of Search ..... 292/259 R, 288, 292/289, 6, DIG. 16, DIG. 38

[56] References Cited

U.S. PATENT DOCUMENTS

| | | | |
|---|---|---|---|
| 3,280,606 | 10/1966 | Howard et al. | 292/259 R |
| 3,809,417 | 5/1974 | Craig | 292/259 R |
| 3,955,841 | 5/1976 | Walker | 292/259 R |
| 4,067,598 | 1/1978 | Mansour | 292/259 R |
| 4,082,332 | 4/1978 | Palmer | 292/259 R |
| 4,105,233 | 8/1978 | Levey | 292/288 |
| 4,548,436 | 10/1985 | Cole, Jr. | 292/292 |
| 4,667,992 | 5/1987 | Roden, Jr. | 292/259 R |
| 4,974,889 | 12/1990 | North | 292/259 R |
| 4,979,769 | 12/1990 | Salyer | 292/338 |
| 5,165,741 | 11/1992 | Everett | 292/259 R |
| 5,218,341 | 6/1993 | Marik | 292/339 X |
| 5,232,254 | 8/1993 | Teaff | 292/259 R |

FOREIGN PATENT DOCUMENTS

| | | | |
|---|---|---|---|
| 413085 | 7/1934 | United Kingdom | 292/148 |

*Primary Examiner*—Peter M. Cuomo
*Assistant Examiner*—Monica E. Millner
*Attorney, Agent, or Firm*—Brian D. Smith

[57] ABSTRACT

An energy absorbing security door bar system is disclosed. The system includes a generally straight elongate member having oppositely facing free ends and the ability to resiliently flex from a straight resting position to a bowed position in which straight lines drawn through the free ends of the elongate member form an included angle of less than about 170 degrees. In addition, the system includes anchoring means for releaseably anchoring the free ends of the elongate member to opposite sides of a door's frame to prevent the door from being opened. A method for preventing forced entry through a door secured with the above security door bar system is also disclosed.

18 Claims, 2 Drawing Sheets

SECURITY DOOR BAR SYSTEM AND METHOD OF USE

TECHNICAL FIELD OF THE INVENTION

The invention relates generally to home security systems and, more particularly to security door bar systems for preventing forced entry into a building through a door.

BACKGROUND OF THE INVENTION

The prior art is replete with security door bar systems for preventing forced entry into a building or home through a door. However, as far as is known there is no existing system which utilizes a resilient flexible security door bar to absorb the energy of an attempted forced entry through a door which would normally occur, for example, when a burglar attempts to gain entry to a building by kicking in the door.

DISCLOSURE OF THE INVENTION

The present invention addresses the aforementioned concern by providing an energy absorbing security door bar system including (1) a generally straight and resiliently flexible elongate member having oppositely facing free ends and the ability to resiliently flex from a straight resting position to a bowed position wherein straight lines drawn through the elongate member's free ends form an included angle of less than about 170 degrees, preferably between about 120 degrees and 170 degrees; and (2) anchoring means for releaseably anchoring the free ends of the elongate member to opposite sides of a door's frame so as to prevent the door from being opened.

In a preferred embodiment of the invention, the elongate member is comprised of telescoping members and in a particularly preferred embodiment the elongate member includes an elongate center section having opposite first and second ends and a pair of first and second elongate end sections. Each of the elongate first and second end sections has an inner end and a free end wherein the inner end of the first end section is in telescoping engagement with the first end of said center section and the inner end of the second end section is in telescoping engagement with the second end of said center section.

In the preferred embodiment, the center and end sections are made out of commercially available polyvinylchloride pipe i.e. referred to herein as PVC pipe and the anchoring means includes eyebolts for anchoring the free ends of the end sections to the opposite sides of a door's frame. Each free end is anchored, as will be appreciated, by inserting it into the "eye" of an eyebolt, one of which is screwed into each side of the door's frame. Thus, with the elongate member anchored or secured as such, the door cannot be opened, i.e. assuming of course the elongate member is anchored or positioned on the side of the door to which the door swings (or opens to) when it is opened.

In the most preferred embodiment of the invention, the anchoring means for anchoring the elongate member to the side of the door frame adjacent the door's handle includes (1) a plate with at least two fastening means for attaching the plate to the door frame and (2) an eyebolt with a rib extending circumferentially around the eyebolt's shah for directing impact forces from the elongate member to the plate, thereby spreading out the impact forces over a greater area. As will be appreciated, by spreading out the impact forces over a greater area, the likelihood of the eyebolt pulling out of the door frame during impact is greatly reduced.

The preferred embodiment also includes means for preventing the elongate member from sliding out of the anchoring means which is provided in the preferred embodiment utilyzing eyebolts by fixedly attaching retaining collars near the free ends of the elongate members' end sections. The collars, as will be appreciated, have a greater diameter than the hole of the eyebolt and thereby prevent the elongate member from sliding through the eyebolt when the free ends of the elongate member's end sections are inserted into their respective eyebolts. Since a collar is provided on each free end of the elongate member, sliding of the elongate member out of the eyebolt i.e. in the opposite direction is also inhibited.

Sliding is inhibited by spring loading the end sections of the elongate member relative to the center section. In the preferred embodiment, a coil spring is inserted into the cylindrical chamber of the center section. The spring should have a diameter which is approximately equal to that of the cylindrical end sections which are located within the respective ends of the center section and in telescoping engagement therewith. Spring loading of the end sections is provided by attaching the end sections to the center section with a post/slot system in which an outwardly projecting post is rigidly affixed to the inner end of each end section and in which a pair of slots is provided in the center section at the first and second ends thereof for receiving the posts such that one post is received in each slot. As will be appreciated, the length of the spring is selected as are the positions of the slots and posts on the center and end sections, respectively, such that a selected degree of spring loading is achieved. In the preferred embodiment, the end sections should be lightly spring loaded so that the average elderly individual can telescopingly slide or retract the end sections inwardly into the center section to a position where the free ends thereof can be inserted into the eyebolts secured to the opposite sides of the door's frame. By lightly spring loading the end sections in this manner, the average elderly person will be able to use the system, i.e. attach it to the eyebolts secured to the door's frame in a position preventing forced entry through the door. Spring loading of the end sections also serves to prevent an intruder from being able to easily slide a free end of the elongate member out of an eyebolt due to the fact that the previously mentioned collars will cooperate with the spring, as will be appreciated, to prevent such sliding.

DETAILED DESCRIPTION OF THE PREFERRED EMBODIMENTS

Figure 1:
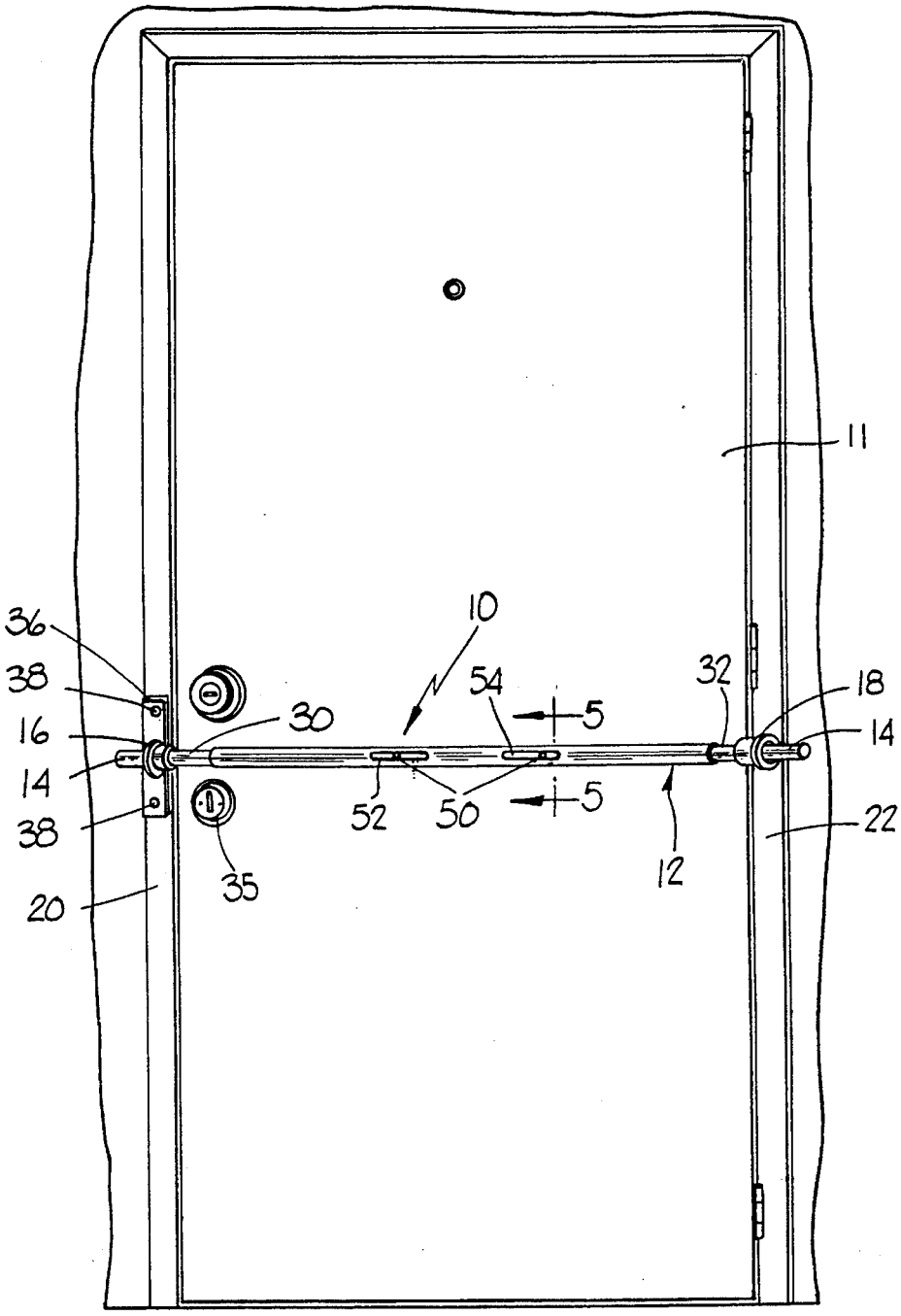
FIG. 1 is a perspective view of a door Secured with a security door bar system of the present invention.

FIGS. 1,2,5 and 6 illustrate a first preferred embodiment of the invention which is an energy absorbing security door bar system 10 for preventing forced entry through a door 11. System 10 generally includes a generally straight and resiliently flexible elongate member 12 having free ends 14 and anchoring means (not numbered) including a pair of eyebolts 16, 18 for releaseably anchoring free ends 14 of the elongate member to opposite sides 20, 22 of the door's frame so as to prevent the door from being opened.

Figure 4:
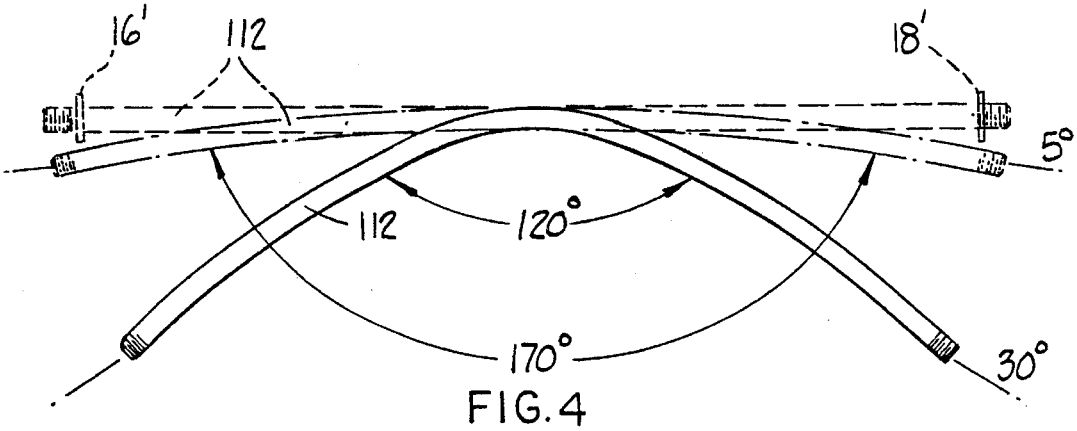
FIG. 4 is a side elevational view of the elongate member of the system of FIG. 3 wherein the elongate member is shown in its bowed position in solid line and in its straight and partially bowed positions in dotted lines.
Figure 6:
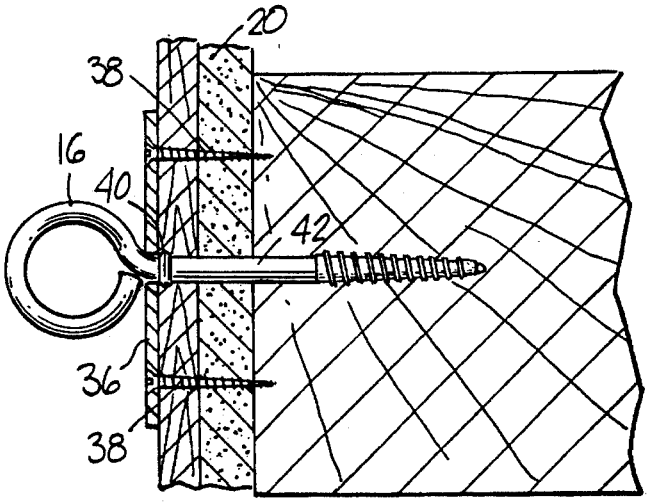
FIG. 6 is a cross-sectional view taken along lines 6—6 of FIG. 3.
Figure 5:
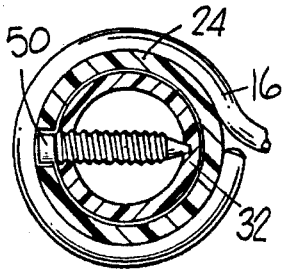
FIG. 5 is a cross-sectional view taken along lines 5—5 of FIG. 1.

An important characteristic of the invention is the elongate member's ability to resiliently flex from a straight resting position to a bowed position wherein straight lines drawn through the elongate member's free ends form an included angle of less than about 170 degrees, preferably between about 120 degrees and 170 degrees. FIG. 4 demonstrates the resilient flexibility of the elongate member of a second embodiment 110 of the present invention wherein it can be seen that elongate member 112 (which has flexibility similar to elongate member 12) has the ability to resiliently flex or bow at least to a position where straight lines drawn through its free ends form an included angle of about 170 degrees and preferably up to an included angle of 120 degrees. Such resilient flexibility is preferably provided in accordance with the present invention by utilyzing PVC pipe for elongate members 12 and 112. While PVC pipe is preferred, other materials providing such resilient flexibility such as other plastic materials and perhaps spring steel may function as desired and are intended to be within the scope of the present invention to the extent they function as desired.

Figure 2:
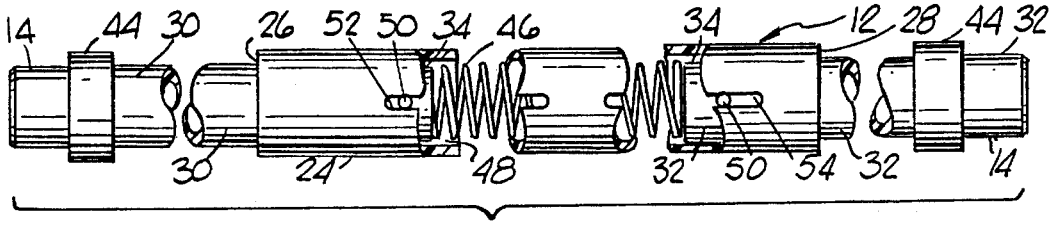
FIG. 2 is a partially broken away side elevational view of the security door bar system of FIG. 1 in which partial sectional views of the system's internal components are also shown.

Returning to the first embodiment, FIGS. 1 and 2 illustrate that elongate member 12 includes an elongate center section 24 having opposite first and second ends 26, 28 and a pair of first and second elongate end sections 30, 32. Each of the elongate first and second end sections 30, 32 has an inner end 34 and a previously mentioned free end 14 wherein the inner end of end section 30 is in telescoping engagement with the first end 26 of center section 24 and the inner end of the second end section 32 is in telescoping engagement with the second end 28 of the center section. The center and end sections 24, 30 and 32 are preferably made out of commercially available PVC pipe as previously alluded to.

The anchoring means for anchoring elongate member 12 to the side of the door frame adjacent the door's handle 35 includes (1) a plate 36 with at least two fastening means such as wood screws 38 for attaching the plate to the door frame and (2) eyebolt 16 which unlike a conventional eyebolt such as eyebolt 18 includes a rib 40 extending circumferentially around the eyebolt's shaft 42 for directing impact forces from the elongate member to the plate, thereby spreading out the impact forces over a greater area. As will be appreciated, by spreading out the impact forces over a greater area, the likelihood of eyebolt 16 pulling out of the door's frame during impact is greatly reduced.

System 10 also includes retaining collars 44 for preventing elongate member 12 from sliding out of eyebolts 16, 18. To prevent the possibility of such sliding, the collars are fixedly attached to elongate member 12 near the free ends 14 of each end section 30, 32. The collars, as will be appreciated, have a greater diameter than the hole of the eyebolts and thereby prevent the elongate member from sliding through an eyebolt when the free ends of the elongate member's end sections are inserted into their respective eyebolts. Since a collar is provided on each free end of the elongate member, sliding of the elongate member out of the eyebolt, i.e. in the opposite direction is also inhibited.

Sliding out of the eyebolts is inhibited by spring loading end sections 30, 32 of the elongate member relative to center section 24. In system 10, a coil spring 46 is inserted into the cylindrical chamber 48 of the center section. The spring should have a diameter which is approximately equal to that of the cylindrical end sections 30, 32 which are positioned within the respective ends of the center section and in telescoping engagement therewith. Spring loading of the end sections is provided by attaching the end sections to the center section with a post/slot system in which an outwardly projecting post 50 is rigidly affixed to the inner end of each end section and in which a pair of slots 52, 54 is provided in the center section at the first and second ends thereof for receiving the posts 50 such that one post is received in each slot. As will be appreciated, the length of the spring is selected as are the positions of the slots and posts on the center and end sections, respectively, such that a selected degree of spring loading is achieved. In system 10, the end sections are lightly spring loaded so that the average elderly individual can telescopingly slide or retract the end sections inwardly into the center section to a position where the free ends thereof can be inserted into the eyebolts secured to the opposite sides of the door's frame. As previously mentioned, by lightly spring loading the end sections in this manner, the average elderly person will be able to use the system, i.e. attach it to the eyebolts secured to the door's frame in a position preventing forced entry through the door. Spring loading of the end sections also serves to prevent an intruder from being able to easily slide a free end of the elongate member out of an eyebolt due to the fact that the previously mentioned collars 44 cooperate with spring 46, as will be appreciated, to prevent such sliding.

Figure 3:
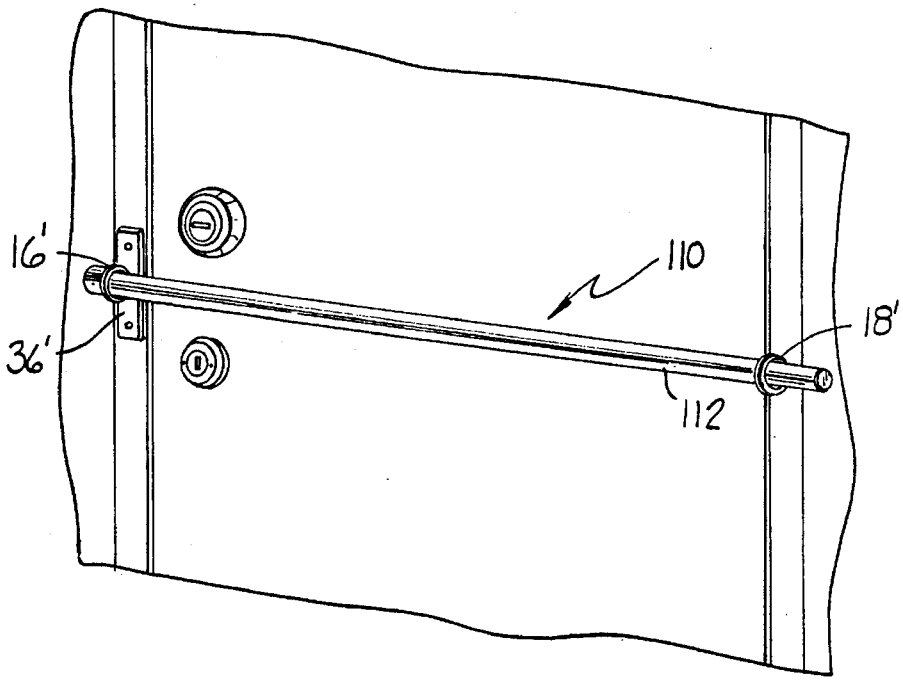
FIG. 3 is a perspective view of a door secured with a another security door bar system of the present invention.

FIG. 3 illustrates the second embodiment 110 of the present invention which performs similarly to system 10 in that it is capable of resiliently flexing as such is illustrated in FIG. 4. Elongate member 112 of this embodiment differs from elongate member 12 of the previous embodiment in that it is one piece as opposed to being comprised of telescoping sections. This system also differs from system 10 in that elongate member 112 is provided with an end cap 114 (which may be a screw on-type end cap) for preventing an intruder from being able to slide the elongate member through eyebolt 16'. The elements of this embodiment which are identical to those of the previous embodiment are similarly numbered with the exception that they are primed.

This invention has been described in detail with reference to particular embodiments thereof, but it will be understood that various other modifications can be effected within the spirit and scope of this invention.

What is claimed is:

1. An energy absorbing security door bar system comprising:

a generally straight hollow elongate member having oppositely facing free ends and the ability to resiliently flex from a straight resting position to a bowed position wherein straight lines drawn through the free ends of said elongate member form an included angle of between 120 and 170 degrees; and anchoring means for releasably anchoring said free ends of said elongate member to opposite sides of a door's frame to prevent the door from being opened.

2. An energy absorbing system as claimed in claim 1 wherein said elongate member comprises telescoping members.

3. An energy absorbing system as claimed in claim 1 wherein said elongate member includes an elongate center section having opposite first and second ends, said elongate member also including a pair of first and second elongate end sections, each of which has an inner end and a free end wherein said inner end of said first end section is in telescoping engagement with said first end of said center section and said inner end of said second end section is in telescoping engagement with said second end of said center section.

4. An energy absorbing system as claimed in claim 3 wherein said elongate center section is provided with a cylindrical chamber.

5. An energy absorbing system as claimed in claim 4 wherein said end sections telescope within the cylindrical chamber of said center section.

6. An energy absorbing system as claimed in claim 5 wherein said end sections are cylindrical.

7. An energy absorbing system as claimed in claim 3 wherein said center section is resilient.

8. An energy absorbing system as claimed in claim 3 wherein said end sections are resilient.

9. An energy absorbing system as claimed in claim 3 wherein said center and end sections are resilient.

10. An energy absorbing system as claimed in claim 1 wherein said anchoring means includes eyebolts for anchoring said elongate member to opposite sides of the door's frame.

11. An energy absorbing system as claimed in claim 1 wherein said anchoring means includes (1) a plate with at least two fastening means for attaching said plate to the door's frame and (2) an eyebolt attached to said plate which is positioned between said eye of said eyebolt and a rib extending circumferentially around the shaft of said eyebolt and rigidly attached thereto for directing impact forces from said elongate member to said plate, thereby spreading out the impact forces over a greater area so as to prevent the eyebolt from being pulled out of the door frame during impact.

12. An energy absorbing security door bar system comprising:

a generally straight hollow elongate member having oppositely facing free ends and the ability to resiliently flex from a straight resting position to a bowed position in which straight lines drawn through said free ends of said elongate member form an included angle of less than about 170 degrees, said elongate member including an elongate center section having opposite first and second ends, said elongate member also including a pair of first and second elongate end sections, each of which has an inner end and a free end wherein said inner end of said first end section is in telescoping engagement with said first end of said center section and said inner end of said second end section is in telescoping engagement with said second end of said center section;

means for spring loading said end sections relative to said center section; and anchoring means for releaseably anchoring said free ends of said elongate member to opposite sides of a door's frame to prevent the door from being opened.

13. An energy absorbing system as claimed in claim 12 wherein said anchoring means includes eyebolts for receiving said free ends of said elongate member to anchor said elongate member to opposite sides of the door's frame and wherein said system further comprises retaining collars fixedly attached to said end sections near the free ends thereof for serving to prevent said end sections from sliding out of said eyebolts.

14. A method for preventing forced entry through a door comprising the steps of:

providing an energy absorbing security door bar system including:

a generally straight hollow elongate member having oppositely facing free ends and the ability to resiliently flex from a straight resting position to a bowed position in which straight lines drawn through the free ends of said elongate member form an included angle of between 120 and 170 degrees; and anchoring means for releaseably anchoring said free ends of said elongate member to opposite sides of a door's frame to prevent the door from being opened;

rigidly attaching the anchoring means to opposite sides of a door's frame on the inwardly opening side of the door; and anchoring the free ends of said elongate member to the anchoring means to prevent the door from being opened.

15. A method as claimed in claim 14 wherein the anchoring means includes eyebolts and the step of anchoring includes inserting the free ends of the elongate member into the eyes of the eyebolts.

16. An energy absorbing system as claimed in claim 1 wherein said elongate member is made from PVC pipe.

17. An energy absorbing system as claimed in claim 12 wherein said spring loading means includes:

a coil spring located between said inner ends of said end sections for biasing each of said end sections apart.

18. An energy absorbing system as claimed in claim 1 wherein said elongate member is cylindrical and has the ability to resiliently flex to a bowed position wherein straight lines drawn through the free ends of said elongate member form an included angle of between 120 and 150 degrees.

* * * * *